US006132029A

United States Patent [19]

Bern

[11] Patent Number: 6,132,029

[45] Date of Patent: Oct. 17, 2000

[54] DIRECT PRINTING METHOD WITH IMPROVED CONTROL FUNCTION

[75] Inventor: Bengt Bern, Mölndal, Sweden

[73] Assignee: Array Printers AB, Vastra Frolunda, Sweden

[21] Appl. No.: 08/871,352

[22] Filed: Jun. 9, 1997

[51] Int. Cl.[7] ..... B41J 2/06

[52] U.S. Cl. ..... 347/55

[58] Field of Search ..... 347/158, 117, 347/55, 20, 144, 77, 82; 399/260

[56] References Cited

U.S. PATENT DOCUMENTS

| | | |
|---|---|---|
| 3,566,786 | 3/1971 | Kaufer et al. . |
| 3,689,935 | 9/1972 | Pressman et al. . |
| 3,779,166 | 12/1973 | Pressman et al. . |
| 3,815,145 | 6/1974 | Tisch et al. . |
| 4,263,601 | 4/1981 | Nishimura et al. . |
| 4,274,100 | 6/1981 | Pond . |
| 4,353,080 | 10/1982 | Cross . |
| 4,382,263 | 5/1983 | Fischbeck et al. . |
| 4,384,296 | 5/1983 | Torpey . |
| 4,386,358 | 5/1983 | Fischbeck . |
| 4,470,056 | 9/1984 | Galetto et al. . |
| 4,478,510 | 10/1984 | Fujii et al. . |
| 4,491,794 | 1/1985 | Daley et al. . |
| 4,491,855 | 1/1985 | Fujii et al. . |
| 4,498,090 | 2/1985 | Honda et al. . |
| 4,511,907 | 4/1985 | Fukuchi . |
| 4,525,727 | 6/1985 | Kohashi et al. . |
| 4,571,601 | 2/1986 | Teshima . |
| 4,675,703 | 6/1987 | Fotland . |
| 4,717,926 | 1/1988 | Hotomi . |
| 4,743,926 | 5/1988 | Schmidlin et al. . |
| 4,748,453 | 5/1988 | Lin et al. . |
| 4,814,796 | 3/1989 | Schmidlin . |
| 4,831,394 | 5/1989 | Ochiai et al. . |
| 4,837,071 | 6/1989 | Tagoku et al. . |
| 4,860,036 | 8/1989 | Schmidlin . |
| 4,903,050 | 2/1990 | Schmidlin . |

(List continued on next page.)

FOREIGN PATENT DOCUMENTS

| | | |
|---|---|---|
| 0345 024 A2 | 6/1989 | European Pat. Off. . |
| 0352 997 A2 | 1/1990 | European Pat. Off. . |
| 0377 208 A2 | 7/1990 | European Pat. Off. . |

(List continued on next page.)

OTHER PUBLICATIONS

E. Bassous, et al., "The Fabrication of High Precision Nozzles by the Anisotropic Etching of (100) Silicon", *J. Electrochem. Soc.: Solid–State Science and Technology*, vol. 125, No. 8, Aug. 1978, pp. 1321–1327.

Jerome Johnson, "An Etched Circuit Aperture Array for TonerJet® Printing", *IS&T's Tenth International Congress on Advances in Non–Impact Printing Technologies*, 1994, pp. 311–313.

"The Best of Both Worlds," Brochure of Toner Jet® by Array Printers, *The Best of Both Worlds*, 1990.

*Primary Examiner*—John Barlow
*Assistant Examiner*—Raquel Yvette Gordon
*Attorney, Agent, or Firm*—Knobbe, Martens, Olson & Bear, LLP

[57] ABSTRACT

A direct electrostatic printing method performed in consecutive print cycles in which control signal pulses are applied on the one hand between a toner particle source and a back electrode and, on the other hand, between the toner particle source and electrodes on a printhead structure interposed between the toner particle source and the back electrode. The pulses are so controlled as to be in accordance with an image configuration to generate a pattern of electrostatic fields which selectively permit or restrict the transport of charged toner particles from the particle source toward the back electrode via the printhead structure. Each pulse signal is either itself frequency pulse modulated or supplemented by an overlaid frequency pulse modulated signal to produce intermittent electric forces which, in a first time phase, attract and transport charged toner particles from the particle source to the printhead structure and, in a second time phase, accelerate the particles towards the back electrode and away from the printhead structure in a convergent, focusing electric field.

13 Claims, 10 Drawing Sheets

U.S. PATENT DOCUMENTS

| | | |
|---|---|---|
| 4,912,489 | 3/1990 | Schmidlin . |
| 5,028,812 | 7/1991 | Bartky . |
| 5,036,341 | 7/1991 | Larsson . |
| 5,038,159 | 8/1991 | Schmidlin et al. . |
| 5,057,855 | 10/1991 | Damouth . |
| 5,072,235 | 12/1991 | Slowik et al. . |
| 5,083,137 | 1/1992 | Badyal et al. . |
| 5,095,322 | 3/1992 | Fletcher . |
| 5,121,144 | 6/1992 | Larson et al. . |
| 5,128,695 | 7/1992 | Maeda . |
| 5,148,595 | 9/1992 | Doggett et al. . |
| 5,170,185 | 12/1992 | Takemura et al. . |
| 5,181,050 | 1/1993 | Bibl et al. . |
| 5,204,696 | 4/1993 | Schmidlin et al. . |
| 5,204,697 | 4/1993 | Schmidlin . |
| 5,214,451 | 5/1993 | Schmidlin et al. . |
| 5,229,794 | 7/1993 | Honman et al. . |
| 5,235,354 | 8/1993 | Larson . |
| 5,237,346 | 8/1993 | Da Costa et al. . |
| 5,256,246 | 10/1993 | Kitamura . |
| 5,257,045 | 10/1993 | Bergen et al. . |
| 5,270,729 | 12/1993 | Stearns . |
| 5,274,401 | 12/1993 | Doggett et al. . |
| 5,287,127 | 2/1994 | Salmon . |
| 5,307,092 | 4/1994 | Larson . |
| 5,329,307 | 7/1994 | Takemura et al. . |
| 5,374,949 | 12/1994 | Wada et al. . |
| 5,386,225 | 1/1995 | Shibata . |
| 5,402,158 | 3/1995 | Larson . |
| 5,414,500 | 5/1995 | Furukawa . |
| 5,446,478 | 8/1995 | Larson . |
| 5,450,115 | 9/1995 | Bergen et al. . |
| 5,453,768 | 9/1995 | Schmidlin . |
| 5,473,352 | 12/1995 | Ishida . |
| 5,477,246 | 12/1995 | Hirabayashi et al. . |
| 5,477,250 | 12/1995 | Larson . |
| 5,506,666 | 4/1996 | Masuda et al. . |
| 5,508,723 | 4/1996 | Maeda . |
| 5,515,084 | 5/1996 | Larson . |
| 5,526,029 | 6/1996 | Larson et al. . |
| 5,558,969 | 9/1996 | Uyttendaele et al. . |
| 5,559,586 | 9/1996 | Wada . |
| 5,600,355 | 2/1997 | Wada . |
| 5,614,932 | 3/1997 | Kagayama . |
| 5,617,129 | 4/1997 | Chizuk, Jr. et al. . |
| 5,625,392 | 4/1997 | Maeda . |
| 5,640,185 | 6/1997 | Kagayama . |
| 5,650,809 | 7/1997 | Kitamura . |
| 5,666,147 | 9/1997 | Larson . |
| 5,677,717 | 10/1997 | Ohashi . |
| 5,708,464 | 1/1998 | Desie . |
| 5,774,159 | 6/1998 | Larson . |
| 5,805,185 | 9/1998 | Kondo . |
| 5,818,480 | 10/1998 | Bern et al. . |
| 5,818,490 | 10/1998 | Larson . |
| 5,847,733 | 12/1998 | Bern . |

FOREIGN PATENT DOCUMENTS

| | | |
|---|---|---|
| 0660 201 A2 | 6/1995 | European Pat. Off. . |
| 072 072 A2 | 7/1996 | European Pat. Off. . |
| 0 743 572 A1 | 11/1996 | European Pat. Off. . |
| 0752 317 A1 | 1/1997 | European Pat. Off. . |
| 0764 540 A2 | 3/1997 | European Pat. Off. . |
| 12 70 856 | 6/1968 | Germany . |
| 26 53 048 | 5/1978 | Germany . |
| 4426333 | 11/1969 | Japan . |
| 55-55878 | 4/1980 | Japan . |
| 55-84671 | 6/1980 | Japan . |
| 55-87563 | 7/1980 | Japan . |
| 56-89576 | 7/1981 | Japan . |
| 58-044457 | 3/1983 | Japan . |
| 58-155967 | 9/1983 | Japan . |
| 62-248662 | 10/1987 | Japan . |
| 62-13356 | 11/1987 | Japan . |
| 01120354 | 5/1989 | Japan . |
| 05220963 | 8/1990 | Japan . |
| 04189554 | 8/1992 | Japan . |
| 4-268591 | 9/1992 | Japan . |
| 4282265 | 10/1992 | Japan . |
| 5208518 | 8/1993 | Japan . |
| 93331532 | 12/1993 | Japan . |
| 94200563 | 8/1994 | Japan . |
| 9048151 | 2/1997 | Japan . |
| 09118036 | 5/1997 | Japan . |
| 2108432 | 5/1983 | United Kingdom . |
| 9014960 | 12/1990 | WIPO . |
| 9201565 | 2/1992 | WIPO . |

DIRECT PRINTING METHOD WITH IMPROVED CONTROL FUNCTION

TECHNICAL FIELD

The present invention relates to a direct electrostatic printing method performed in consecutive print cycles in which control signal pulses are applied between a toner particle source and a back electrode. The pulses are so controlled as to be in accordance with an image configuration to generate a pattern of electrostatic fields which selectively permits or restricts the transport of charged toner particles from the particle source towards the back electrode. The control signal pulses may be applied on the one hand between a toner particle source and a back electrode and, on the other hand, between said toner particle source and a printhead structure interposed between said toner particle source and said back electrode.

The present invention is advantageously applied to a direct electrostatic printing method, in which a stream of computer generated signals, defining an image information, is converted to a pattern of electrostatic fields on control electrodes arranged on a printhead structure. The pattern selectively permits or restricts the transport of charged toner particles through the printhead structure, e.g. from a particle source toward a back electrode, and controls the deposition of the charged toner particles in an image configuration onto an image receiving medium. Particularly, the present invention may be applied to a direct electrostatic printing method performed in consecutive print cycles, each of which includes at least one development period ($t_b$) and at least one recovery period ($t_w$) subsequent to each development period ($t_b$), wherein the pattern of electrostatic fields is produced during at least a part of each development period ($t_b$) to selectively permit or restrict the transport of charged toner particles from a particle source toward a back electrode, and an electric field is produced during at least a part of each recovering period ($t_w$) to repel a part of the transported charged toner particles back toward the particle source.

BACKGROUND OF THE INVENTION

Of the various electrostatic printing techniques, the most familiar and widely utilized is that of xerography wherein latent electrostatic images formed on a charged retentive surface are developed by a suitable toner material to render the images visible, the images being subsequently transferred to plain paper.

Another form of electrostatic printing is one that has come to be known as direct electrostatic printing (DEP). This form of printing differs from the above mentioned xerographic form in that toner is deposited in image configuration directly onto plain paper. The novel feature of DEP printing is to allow simultaneous field imaging and toner transport to produce a visible image on paper directly from computer generated signals, without the need for those signals to be intermediately converted to another form of energy such as light energy, as it is required in electrophotographic printing.

A DEP printing device has been disclosed in U.S. Pat. No. 3,689,935, issued Sep. 5, 1972 to Pressman et al.

Pressman et al. discloses a multilayered particle flow modulator comprising a continuous layer of conductive material, a segmented layer of conductive material and a layer of insulating material interposed therebetween. An overall applied field projects toner particles through apertures arranged in the modulator whereby the particle stream density is modulated by an internal field applied within each aperture.

A new concept of direct electrostatic printing was introduced in U.S. Pat. No. 5,036,341, granted to Larson, and further developed in a co-pending application.

According to Larson, a uniform electric field is produced between a back electrode and a developer sleeve coated with charged toner particles. A printhead structure, such as a control electrode matrix, is interposed in the electric field and utilized to produce a pattern of electrostatic fields which, due to control in accordance with an image configuration, selectively open or close passages in the printhead structure, thereby permitting or restricting the transport of toner particles from the developer sleeve toward the back electrode. The modulated stream of toner particles allowed to pass through the opened passages impinges upon an image receiving medium, such as paper, interposed between the printhead structure and the back electrode.

According to the above method, a charged toner particle is held on the developer surface by adhesion forces, which are essentially proportional to $Q^2/d^2$, where d is the distance between the toner particle and the surface of the developer sleeve, and Q is the particle charge. The electric force required for releasing a toner particle from the sleeve surface is chosen to be sufficiently high to overcome the adhesion forces.

However, due to relatively large variations of the adhesion forces, toner particles exposed to the electric field through an opened passage are neither simultaneously released from the developer surface nor uniformly accelerated toward the back electrode. As a result, the time period from that the first particle is released until all released particles are deposited onto the image receiving medium is relatively long.

As described above, a continuous voltage signal is utilized to modulate a stream of toner particles through a pattern of apertures, opening or closing apertures during predetermined time periods (development periods) during which toner is released from the toner particle source and transported through the opened apertures to the back electrode and the image receiving medium, eg. a paper sheet. When utilizing a continuous control signal (e.g. +300 V) during a specific time period, an amount of particles is released from the particle source and exposed to an attraction force from the back electrode electromagnetic field. Particles which have gained sufficient momentum to pass through the aperture before the end of the time period are still influenced by the control signal even after passage through the aperture and are thus exposed to a divergent electromagnetic field which may cause scattering of the toner particles. On the other hand, particles passing through the aperture immediately after the end of the time period are, during their transport from the aperture towards the back electrode, subjected to a more convergent field which provides more focused transport trajectories and thereby smaller dots. This first state prolongs the time of transport to the back electrode and also elongates the stream of toner particles, which leads to a delayed deposition on the image receiving medium and thus a lower print uniformity at lower speeds. The toner particle stream is also scattered, which results in larger dots and hence a lower print resolution.

This drawback is particularly critical when using dot deflection control. Dot deflection control consists of performing several development steps during each print cycle to increase print resolution. For each development step, the symmetry of the electrostatic field is modified in a specific direction, thereby influencing the transport trajectories of toner particles toward the image receiving medium. This allows several dots to be printed through each single passage during the same print cycle, each deflection direction corresponding to a new dot location. To enhance the efficiency of dot deflection control, it is particularly essential to decrease the toner transport time and to ensure direct transition from one deflection direction to another, without delayed toner deposition. For example, a 600 dpi (dots per inch) deflection control requires a dot diameter below 60 microns and high speed, eg. 10 ppm (pages per minute); dot deflection printing requires shorter toner transport time and faster transition. It is thus essential to ensure that all toner particles released from the toner source are given enough time for all toner particles to be deposited onto the image receiving medium before a transition is made from one deflection direction to another.

Therefore, in order to achieve higher speed printing with improved print uniformity, and in order to improve dot deflection control, there is still a need to improve DEP methods which allows shorter toner transport time and reduces delayed toner deposition and also lowers the consumption of toner per development time unit.

A DEP method in accordance with the above is performed in consecutive print cycles, each of which includes at least one development period $t_b$ and at least one recovery period $t_w$ subsequent to each development period $t_b$. This DEP method thus includes the steps of:

providing a particle source, a back electrode and a printhead structure positioned therebetween, said printhead structure including an array of control electrodes connected to a control unit;

positioning an image receiving medium between the printhead structure and the back electrode;

producing an electric potential difference between the particle source and the back electrode to apply an electric field which enables the transport of charged toner particles from the particle source toward the back electrode; and during each development period $t_b$ or selected parts thereof, applying variable electric potentials to the control electrodes to produce a pattern of electrostatic fields which, due to control in accordance with an image configuration, open or close passages/apertures through the printhead structure to selectively permit or restrict the transport of charged particles from the particle source onto the image receiving medium.

When toner particles have passed through an aperture, it has been observed that their transport trajectory is influenced by the control potential of the control electrode pertaining to each aperture. If the control potential is still "ON" (i.e. equals $V_{on}$), the toner particle stream tends to be more scattered. If the control potential instead is "OFF" (i.e. equals $V_{off}$), the toner particle stream will be more focused.

Thus, the optimal condition is when the control potential is "ON" during the transport of toner particles from the toner particle source, e.g. a developer sleeve, to the printhead structure and immediately switched "OFF" as soon as the toner particles have reached the aperture.

SUMMARY OF THE INVENTION

The present invention satisfies a need for improved DEP methods by providing intermittent control pulses in print conditions, where the intermittent pulses vary between at least two levels, wherein a first level is chosen to enhance toner release from the particle source and initiate toner particle transport from the particle source to the apertures in the printhead structure, and a second level is chosen to enhance toner particle stream convergence during transport of particles from the aperture towards the back electrode.

The present invention thus satisfies a need for improved DEP methods by providing high-speed transition from print conditions to non print conditions and shorter toner transport time with a more convergent toner particle stream, thereby allowing smaller dot sizes to be printed. This results in an improved possibility to control the dot size, i.e. to modulate the dot stream convergence, which is essential when using dot deflection printing methods. Smaller dot sizes makes it possible to reach higher print addressability. For example, a 600 dpi printing resolution requires 1/600 inch dot diameter, or about 42 microns, to make it possible to distinguish between two adjacent dots. The apertures in the printhead structure have a diameter of about 140 microns, which implies that it is necessary to focus the toner particle stream.

A major problem associated with the focusing of the toner particle stream is that particles released early during the print or "black" time period are still under the influence of the "ON"-potential, even after passing through an opened aperture, while later released particles are exposed to an "OFF"-potential. This means that only the later released particles are going to be sufficiently focused due to the stronger acceleration forces which act upon these particles and hence provide a shorter transport time together with a higher field convergence.

Due to variations in toner particle charge, particle size and particle layer thickness, the particles are not uniformly accelerated from the developer sleeve, resulting in a relatively long train of toner particles leaving the developer sleeve and being transported towards the printhead structure.

In order to solve the problem associated with the earlier released particles, an intermittent particle transport will have to be effected, where the control pulse is split into a plurality of "release-focus" cycles and where the sequences are adjusted to obtain a shift between pulse and no pulse or vice versa immediately after the toner particles have passed through the aperture. To produce shorter toner particle trains or streams, the control potential "ON" periods are shortened and a plurality of control potential pulses are used instead of one longer control potential signal.

The present invention further satisfies high speed transition from one deflection direction to another, and thereby improved dot deflection control.

A direct electrostatic printing method according to the present invention is performed in consecutive print cycles in which control signal pulses are applied between a toner particle source and a back electrode. The pulses are so controlled as to be in accordance with an image configuration to generate a pattern of electrostatic fields which selectively permits or restricts the transport of charged toner particles from the particle source towards the back electrode. Each control pulse signal is frequency pulse modulated to produce intermittent electric forces which, in a first time phase, attract and transport charged toner particles from the surface of the particle source and, in a second time phase, accelerate the particles towards the back electrode and away from the particle source.

In this way, the toner particle transport is performed in consecutive steps by providing the control potential as periodic pulses oscillating between at least two levels. A first level is chosen so that retention forces, acting on the toner particles on the developer sleeve, are overcome and the transport of toner particles is initiated. A second level is chosen so that the transport of toner particles from the aperture towards the back electrode (and hence the image receiving medium, e.g. a paper sheet) is enhanced, resulting in a better focusing of the toner particle stream. The first level is utilized during the time period required for toner particle transport from the developer sleeve to the printhead structure, then a switch is made to the second level until the toner particles are deposited on the image receiving medium.

According to another embodiment of the present invention, the printhead structure further includes at least two sets of deflection electrodes comprised in an additional printed circuit, preferably arranged on said bottom surface of the substrate layer. Each aperture is at least partially surrounded by a first and a second deflection electrodes disposed around two opposite segments of the periphery of the aperture.

Each first and second deflection electrodes are similarly disposed in relation to their corresponding aperture and connected to a first and a second deflection voltage source, respectively.

The first and second deflection voltage sources supply variable deflection potentials D1 and D2, respectively, such that the toner transport trajectory is controlled by modulating the potential difference D1–D2. The dot size is controlled by modulating the amplitude levels of both deflection potentials D1 and D2, in order to produce converging forces for focusing the toner particle stream passing through the apertures.

The present invention also relates to a control function in a direct electrostatic printing method, in which each print cycle includes at least one development period $t_b$ and at least one recovery period $t_w$ subsequent to each development period $t_b$. The variable control potentials are supplied to the control electrodes during at least a part of each development period $t_b$, and have amplitude and pulse width chosen as a function of the intended print density. A shutter potential is applied to the control electrodes during at least a part of each recovery period $t_w$ to close the apertures and thus prevent toner particles from passing through the apertures.

The present invention also relates to a direct electrostatic printing device for accomplishing the above method.

Other objects, features and advantages of the present invention will become more apparent from the following description when read in conjunction with the accompanying drawings in which preferred embodiments of the invention are shown by way of illustrative examples.

BRIEF DESCRIPTION OF THE DRAWINGS

Although the examples shown in the accompanying drawings illustrate a method wherein toner particles have negative charge polarity, this method can be performed with particles having positive charge polarity without departing from the scope of the present invention. In this case, all potential values will be given the opposite sign.

DETAILED DESCRIPTION OF PREFERRED EMBODIMENTS:

Three basic embodiments of the present invention will now be further described by way of examples. The basic idea of applying the control signals as a plurality of pulses is common to all three, but the embodiments differ as to what means are used to apply the pulses.

In a first embodiment, the multiple pulses are applied to control electrodes on the printhead structure facing the particle source.

In a second embodiment, the multiple pulses are applied to guard electrodes arranged on the surface of the printhead structure which is facing the back electrode. The pulses may have a first level, e.g. 0 V or $V_w$, for enhancing the release forces generated by the control electrodes and a second level for increasing the convergence forces on the toner particle stream after its passage through the aperture in the printhead structure.

In a third embodiment, the multiple pulses are applied to deflection electrodes which are also located on the surface of the printhead structure which is facing the back electrode. The deflection voltage levels are modulated while maintaining a constant deflection potential difference between the two deflection electrodes. This has the effect that the converging field is directed in the direction of deflection as compared to in the direction of an axis through the aperture as in the second embodiment.

Each electrode may be connected to at least one driving unit, such as a conventional IC-driver, which supplies variable control potentials having levels comprised in a range between $V_{off}$ and $V_{on}$, where $V_{off}$ and $V_{on}$ are chosen to be below and above a predetermined threshold level, respectively. The threshold level is determined by the energy required to overcome the adhesion forces holding toner particles on the particle source.

Figure 1A:
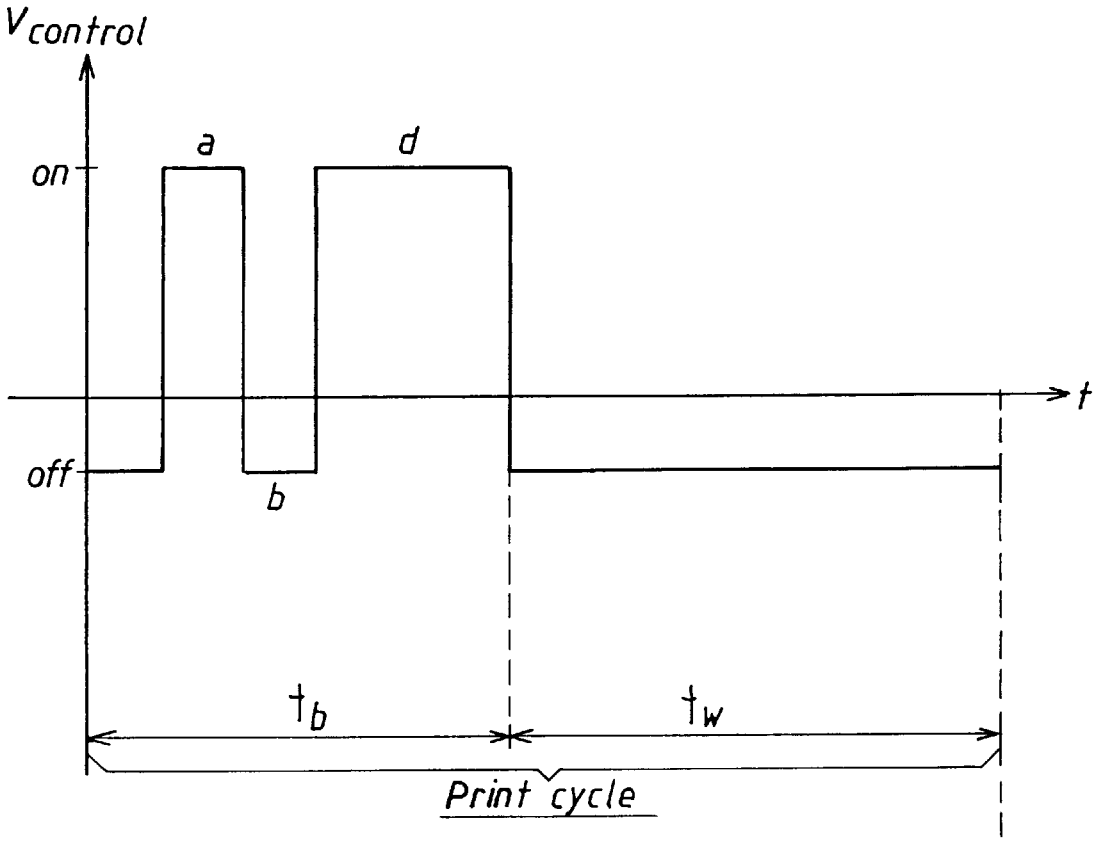
FIG. 1*a* is a diagram showing the voltages applied to a selected control electrode during a print cycle including a development period $t_b$ and a recovery period $t_w$.

FIG. 1*a* shows the control potential ($V_{control}$) and the periodic voltage pulse (V) applied on a control electrode during a print cycle according to a first embodiment of the invention. According to this example, the print cycle includes one development period $t_b$ and one subsequent recovery period $t_w$. The control potential ($V_{control}$) has an amplitude comprised between a full print density level $V_{on}$ and a toner particle repulsion level $V_{off}$. A first short pulse, marked "a", liberates a number of toner particles from a particle source, e.g. a developer sleeve. The subsequent pulse, marked "b", which is of opposite polarity, redirects the toner particles back towards a layer of toner particles present on the surface of the developer sleeve. The b-pulse is applied before the toner particles have passed through the aperture in the printhead structure. The turbulence caused by the returning toner particles in the toner layer facilitates the release of new toner particles which is accomplished with a pulse "d", of the same polarity as the a-pulse but of longer duration. Toner particles situated deeper down in the toner layer in this way receive mechanical help to lower the necessary release forces. The d-pulse then shoots the toner particles from the developer sleeve towards and past the printhead structure, through the aperture.

Typical voltage levels used for the pulses are +350 V for a/d and −50 V for b. These values depend on the available driver circuits.

Figure 1B:
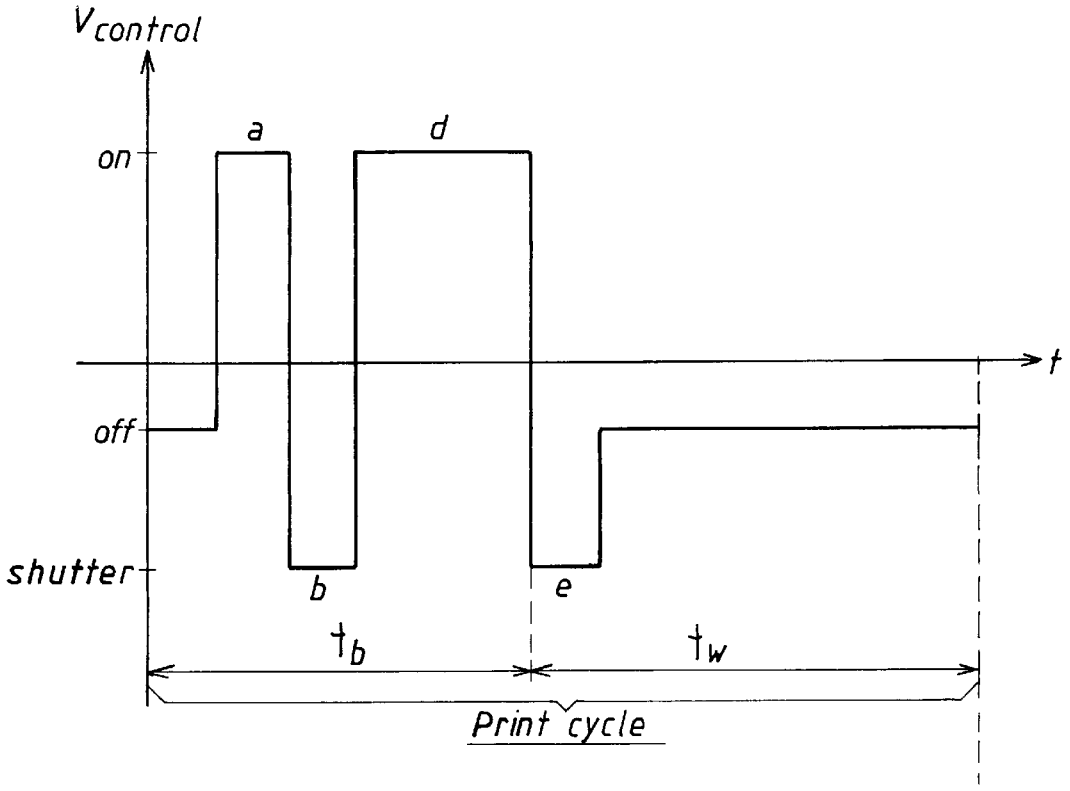
FIGS. 1*b* and 1*c* are diagrams showing the voltages applied to a selected control electrode during a print cycle including a development period $t_b$ and a recovery period $t_w$ according to a further embodiment of the invention.
Figure 1C:
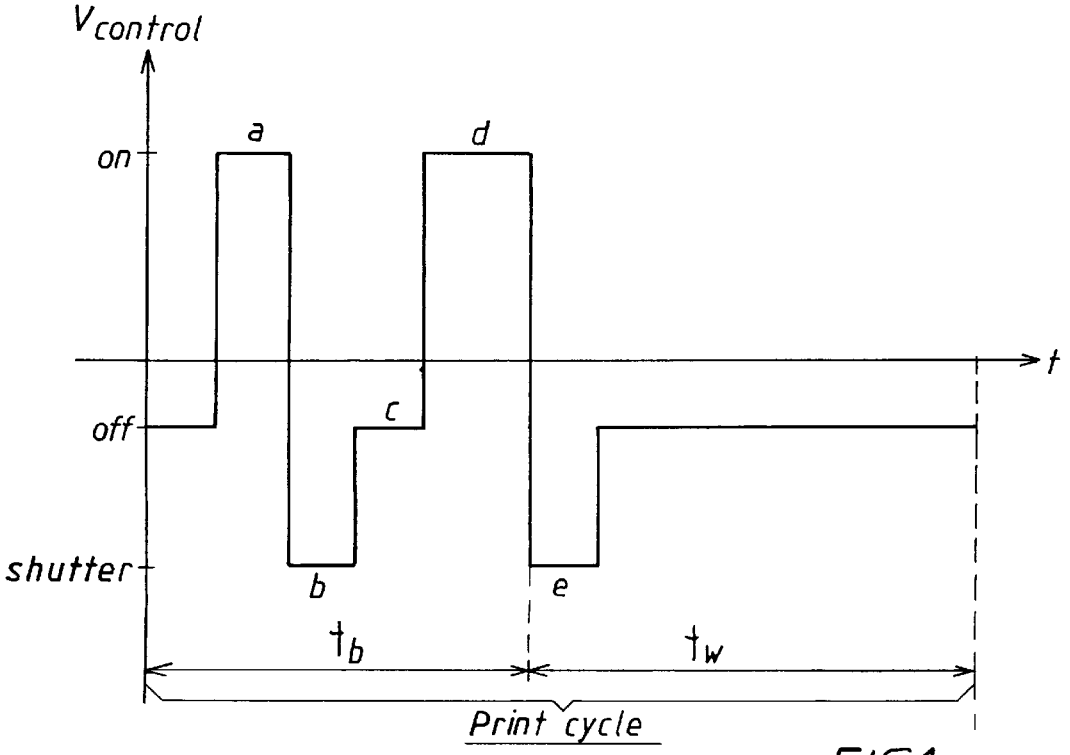

A further version of this embodiment also includes the use of a shutter potential signal applied to the control electrodes during the $t_w$ period. The control signal is switched to $V_{off}$ during this period and the resultant voltage level applied to the control electrodes is called $V_{shutter}$. The shutter voltage level comprises $V_{off}$, typically −50 V, and an overlaid voltage signal, typically −300 V, which is applied to all control electrodes from a common voltage source. This signal is thus applied to all control electrodes, even those which have not received a print voltage signal ($V_{on}$). $V_{off}$ and the overlaid voltage signal are of opposite sign compared to $V_{on}$. With a Von signal of +350 V, a symmetrical span of +/−350 V is available between $V_{on}$ and $V_{shutter}$. The overlaid voltage signal is advantageously applied during the whole $t_w$ period, and may also be applied during the b-pulse period to strengthen the b-pulses. This is shown in FIGS. 1*b* and 1*c*, where the b-pulses have an additional overlaid voltage as defined above to typically reach −350 V ($V_{shutter}$). This enhances the toner particle excitation effect of the a-, b- and d-pulse combination. A pulse marked "e" may be applied at the beginning of the $t_w$ period to enhance toner particle focusing. Alternatively, the $V_{shutter}$ signal may be applied during the whole $t_w$ period as in the above example.

The d-pulse portion of the control potential ($V_{control}$) has a pulse width which can vary, but the whole pulse is delayed so that it ends at $t=t_b$. At $t=t_b$, the periodic voltage pulse V may be switched from a first level to a shutter level ($V_{shutter}$). The shutter potential has the same sign as the charge polarity of the toner particles, thereby applying repelling forces on the toner particles. These repelling forces are directed away from the control electrodes, whereby all toner particles which have already passed the apertures are accelerated toward the back electrode, while toner particles which are still located in the gap between the particle source and the control electrodes at $t=t_b$ are reversed toward the particle source. As a result, the particle flow is cut off almost instantaneously at $t=t_b$.

Using multiple pulses, a/b/d, makes it possible to shorten $t_b$. The duration of $t_b$ can then be chosen so that the toner particle stream is ideally situated between the printhead structure and the image receiving medium, which facilitates and enhances the focusing of the toner particle stream on the medium.

FIG. 1*c* shows a further embodiment based on FIG. 1*b*. The difference is that a period of $V_{off}$ potential, i.e. no toner particles are influenced by the control voltage, is inserted between the b-pulse and the d-pulse of FIG. 1*a*, resulting in an assured flow-back of toner particles to the developer sleeve. The inserted pulse of $V_{off}$ potential is marked "c".

Figure 2:
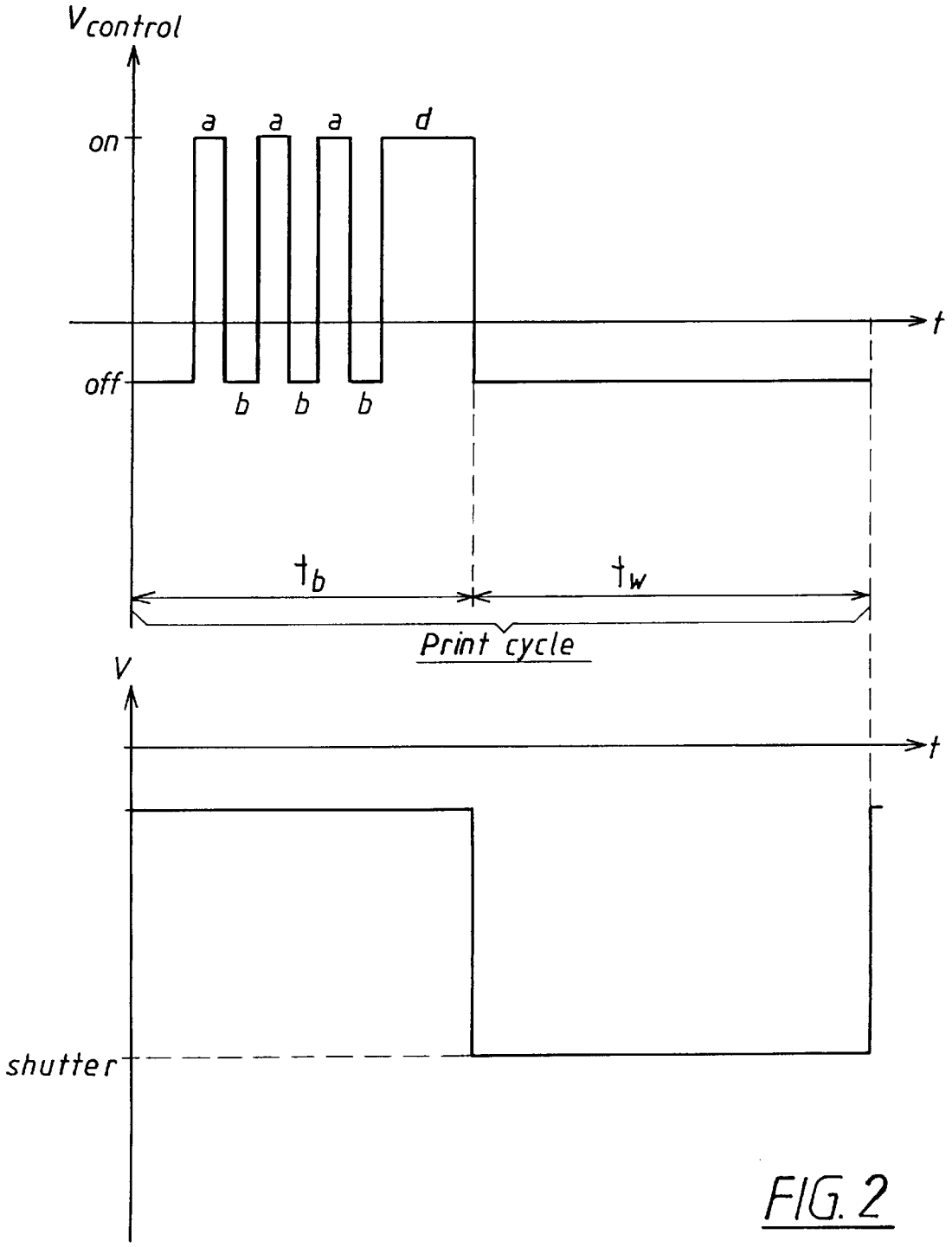
FIG. 2 is a diagram showing a multitude of voltage pulses being applied in a similar way to FIGS. 1*a* and 1*b;*

FIG. 2 illustrates a print cycle wherein a plurality of a-pulse/b-pulse changeovers are performed to ascertain a plurality of smooth and concentrated streams of toner particles during the d-pulse period. The number of a-pulse/b-pulse changeovers used may also serve to regulate the amount of toner particles used to print one dot, thus regulating the transparency of the dot, i.e. the greyscale in b/w printing. If two pulses, and hence two toner streams, are used to print each dot, the first toner stream does not have to reach the image receiving medium before the second pulse is initiated. The only requirement is that the first toner stream is situated between the printhead structure and the image receiving medium before the next toner stream is sent off with the required second pulse.

The width of each pulse, i.e. its duration, and also the time delay between different pulses, may be varied to achieve the desired different dot densities, dot transparencies (eg. greyscales) and/or dot sizes. For example, a certain number of a-pulse/b-pulse combinations in FIG. 2 may be omitted to produce different dot transparencies.

Figure 3B:
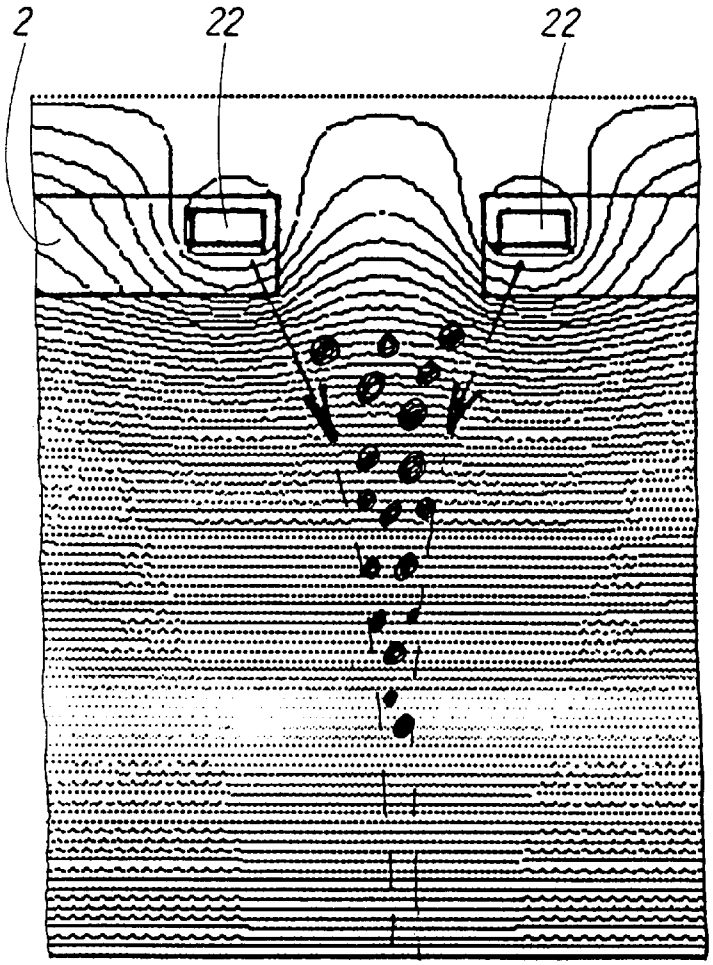
FIGS. 3*a* and 3*b* are schematic sectional views of a printhead structure with approximate electromagnetic field lines added.
Figure 3A:
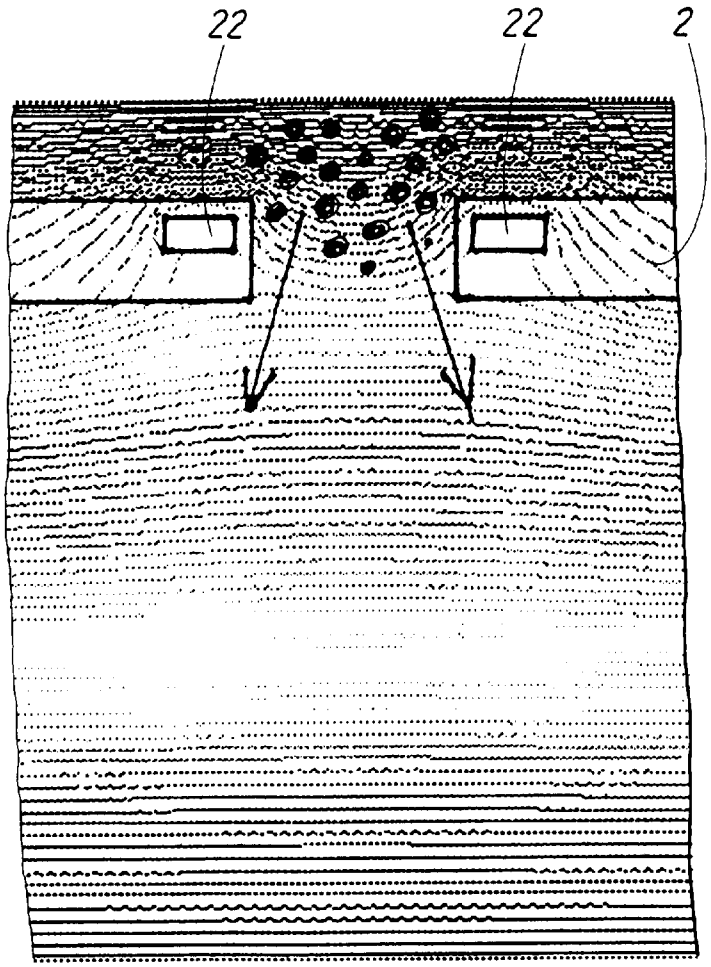

FIGS. 3*a* and 3*b* show the printhead structure and a schematic representation of the electromagnetic field on one hand when an a-pulse is present, i.e. a $V_{on}$ signal is applied (FIG. 3*a*) and on the other hand when a b-pulse is present, i.e. a $V_{off}$ signal is applied as specified in FIGS. 1*a*, 1*b*, 1*c* and 2.

Figure 4A:
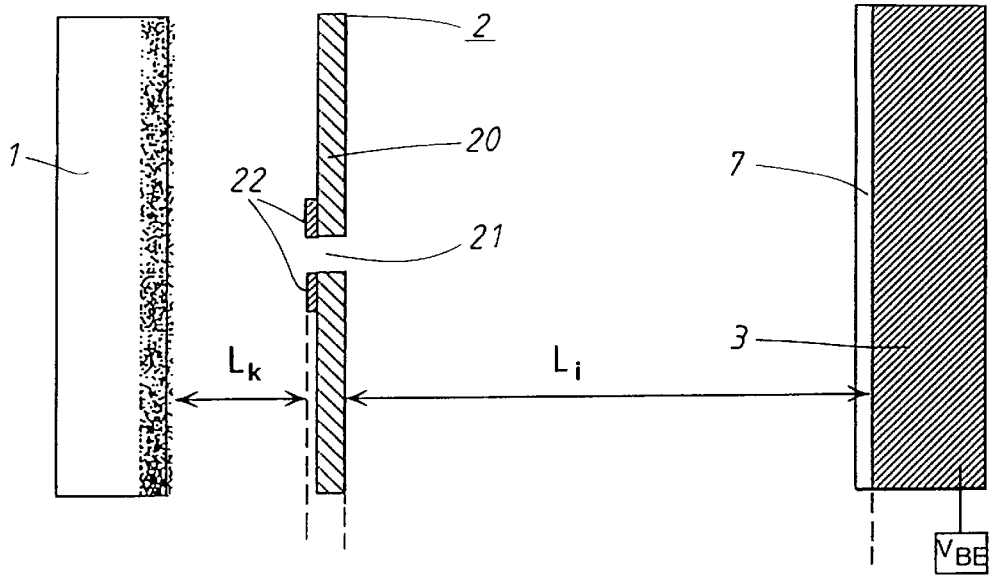
FIG. 4*a* is a schematic sectional view of a print zone of a DEP device.

FIG. 4*a* is a schematic sectional view through a print zone in a direct electrostatic printing device. The print zone comprises a particle source 1, a back electrode 3 and a printhead structure 2 arranged therebetween. The printhead structure 2 is located at a predetermined distance $L_k$ from the particle source and at a predetermined distance $L_k$ from the back electrode. The printhead structure 2 includes a substrate layer 20 of electrically insulating material having a plurality of apertures 21 arranged through the substrate layer 20, each aperture 21 being at least partially surrounded by a control electrode 22. An image receiving medium 7 is conveyed between the printhead structure 2 and the back electrode 3.

The particle source 1 is preferably arranged on a rotating developer sleeve having a substantially cylindrical shape and a rotation axis extending parallel to the printhead structure 2. The sleeve surface is coated with a relatively thin layer of charged toner particles held on the sleeve surface by adhesion forces due to charge interaction with the sleeve material. The developer sleeve is preferably made of metallic material even if a flexible, resilient material is preferred for some applications. The toner particles are generally non magnetic particles having negative charge polarity and a narrow charge distribution in the order of about 4 to 10 $\mu$C/g. The printhead structure is preferably formed of a thin substrate layer of flexible, non-rigid material, such as polyimid or the like, having dielectrical properties. The substrate layer 20 has a top surface facing the particle source and a bottom surface facing the back electrode, and is provided with a plurality of apertures 21 arranged therethrough in one or several rows extending across a print zone. Each aperture is at least partially surrounded by a preferably ring-shaped control electrode 22 of conductive material, such as for instance copper, arranged in a printed circuit preferably etched on the top surface of the substrate layer. Each control electrode is individually connected to a variable voltage source, such as a conventional IC driver, which, due to control in accordance with the image information, supplies the variable control potentials in order to at least partially open or close the apertures as the dot locations pass beneath the printhead structure. All control electrodes are connected to an additional voltage source which supplies the periodic voltage pulse oscillating from a first potential level applied during each development period $t_b$ and a shutter potential level applied during at least a part of each recovering period $t_w$.

Figure 4B:
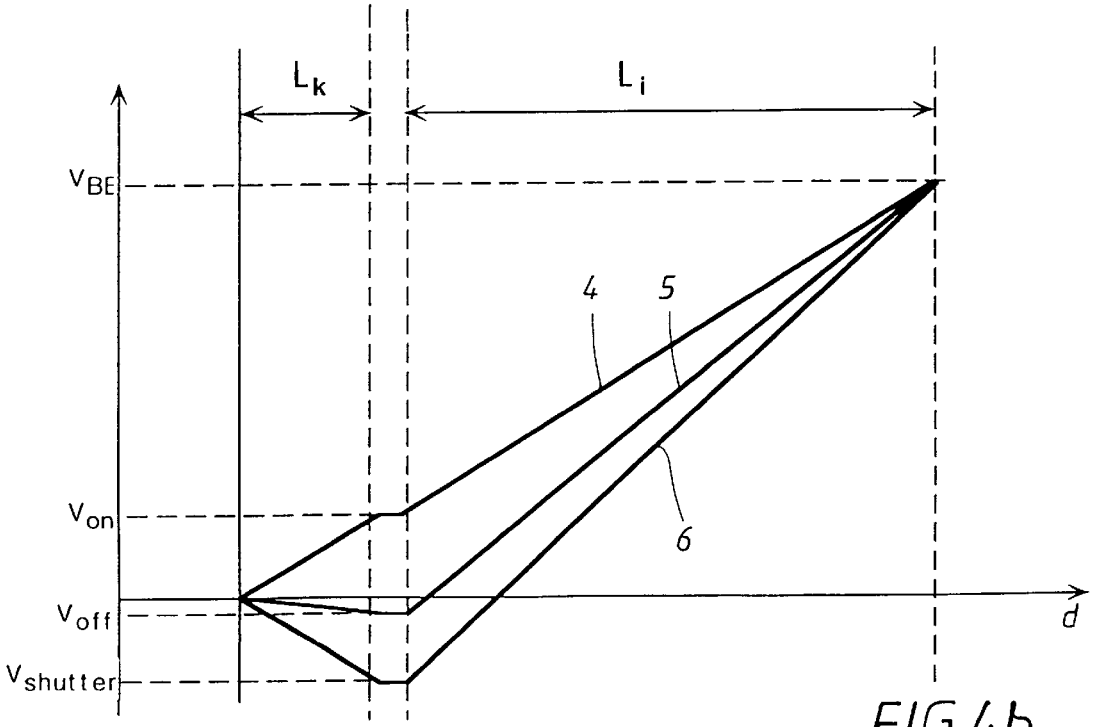
FIG. 4*b* is a diagram illustrating the electric potential as a function of the distance from the particle source to the back electrode, referring to the print zone of FIG. 3*a;*

FIG. 4*b* is a schematic diagram showing the applied electric potential as a function of the distance d from the particle source 1 to the back electrode 3. Line 4 shows the potential function during a development period $t_b$, as the control potential is set on print condition ($V_{on}$). Line 5 shows the potential function during a development period $t_b$, as the control potential is set in non print condition ($V_{off}$). Line 6 shows the potential function during a recovery period $t_w$, as the shutter potential is applied ($V_{shutter}$). The control voltage thus oscillates between $V_{on}$ and $V_{shutter}$ during the phase of alternating a- and b-pulses. A negatively charged toner particle located in the $L_k$-region is transported toward the back electrode as long as the print potential $V_{on}$ is applied (line 4) and is repelled back toward the particle source as soon as the potential is switched to the shutter level (line 6). At the same time, a negatively charged toner particle located in the $L_t$-region is accelerated toward the back electrode as the potential is switched from $V_{on}$ (line 4) to $V_{shutter}$ (line 6). In the embodiments where no shutter potential is used, line 6 is omitted and the control voltage then oscillates between $V_{on}$ and $V_{off}$.

Figure 5A:
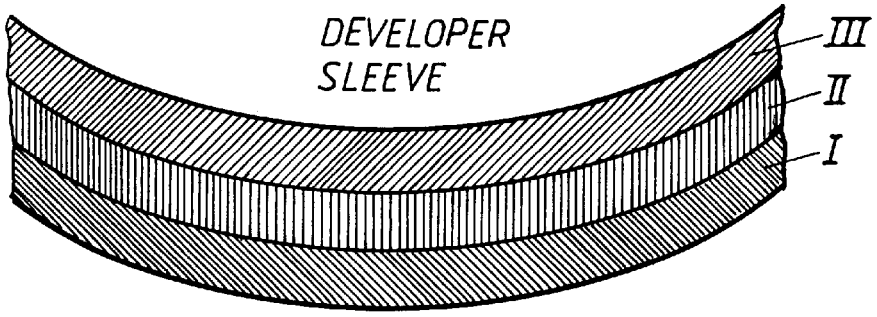
FIG. 5*a* is a schematic section of the outer surface of the developer sleeve, i.e. toner particle source.
Figure 5B:
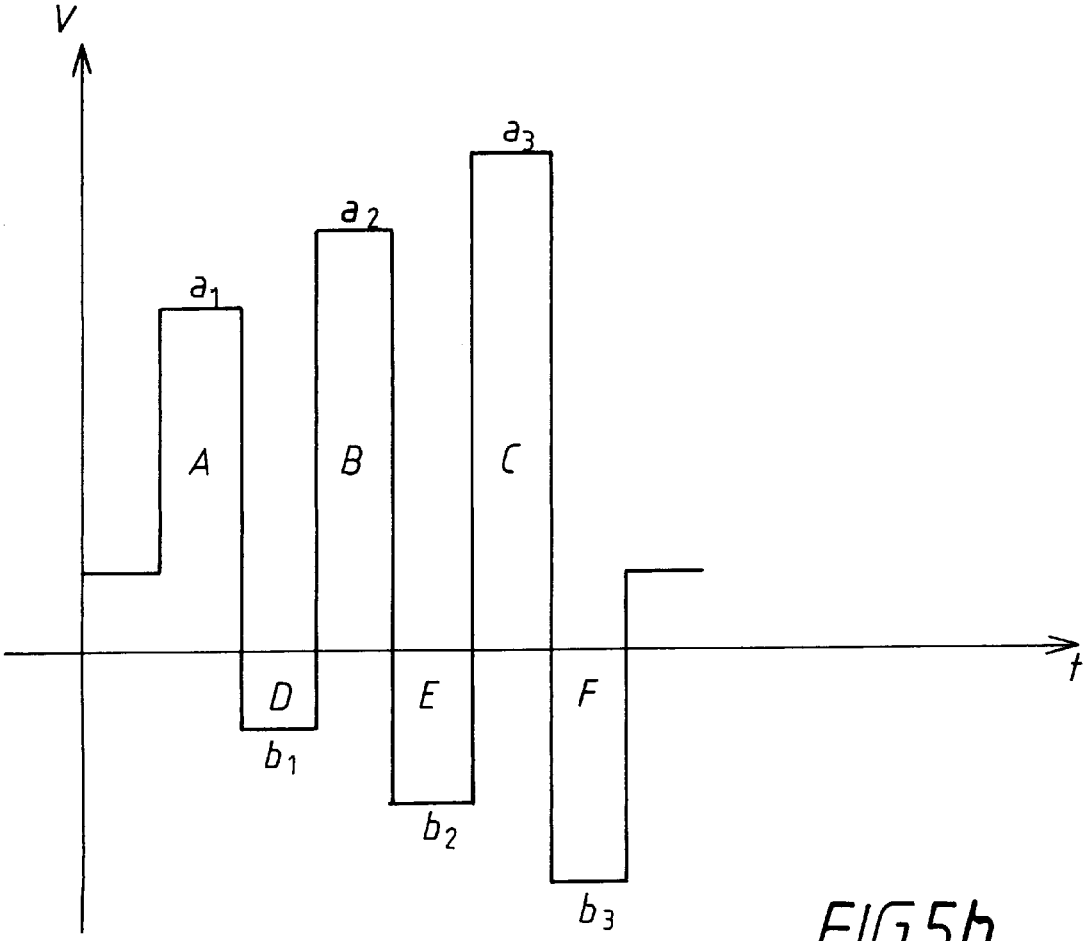
FIG. 5*b* is a diagram showing the voltages applied to a selected control electrode during a print cycle, according to another embodiment of the invention and referring to FIG. 5*a;*

FIGS. 5*a* and 5*b* show an alternative embodiment of the invention in which not only the control voltage is divided into a plurality of pulses at the beginning of $t_b$, as shown in FIG. 2, but also amplitude modulated into pulses $a_1$, $a_2$ and $a_3$, having increasing amplitudes, marked A, B and C respectively and pulses $b_1$, $b_2$ and $b_3$ having amplitudes, preferably of opposite sign compared to the pulses $a_1$, $a_2$ and $a_3$, also of increasing magnitude D, E and F, respectively. A first pulse having the amplitude A would remove toner particles in an outer layer I of FIG. 5*a*, a second pulse having the amplitude B would then remove toner particles in an intermediate layer II and, finally, a third pulse having the amplitude C which removes toner particles in an inner layer III. Any number of pulses may be used corresponding to a certain number of toner particle layers on the toner particle source.

Figure 6:
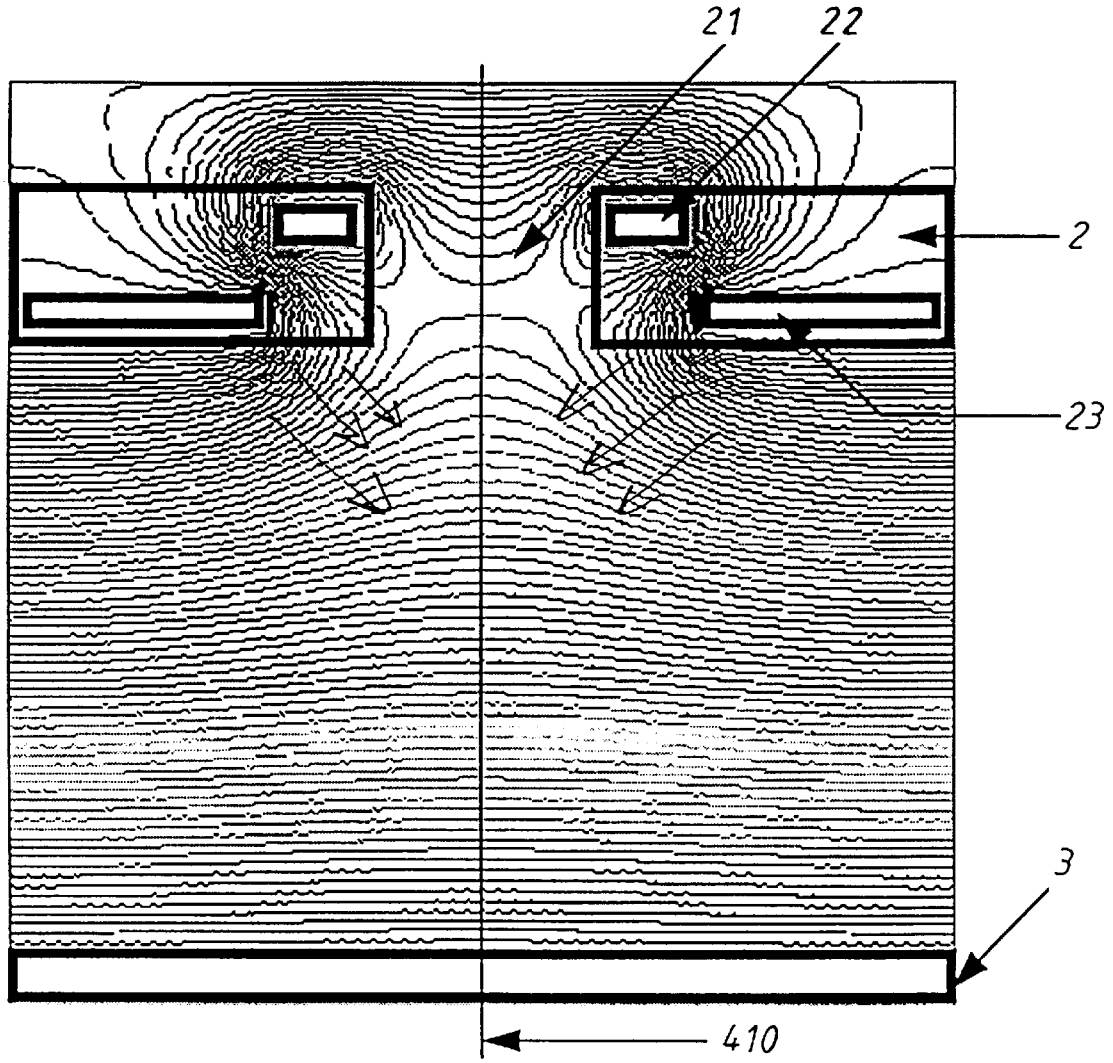
FIG. 6 is a schematic sectional view of a print zone of a DEP device according to another embodiment of the invention, in which the printhead structure includes guard electrodes.

FIG. 6 shows a second embodiment of the invention where guard electrodes 23 are arranged opposite the control electrodes 22 on a printhead structure 2. Both sets of electrodes encircle an aperture 21 in the printhead structure. The multiple pulses are preferably applied only to the guard electrodes.

Figure 7:
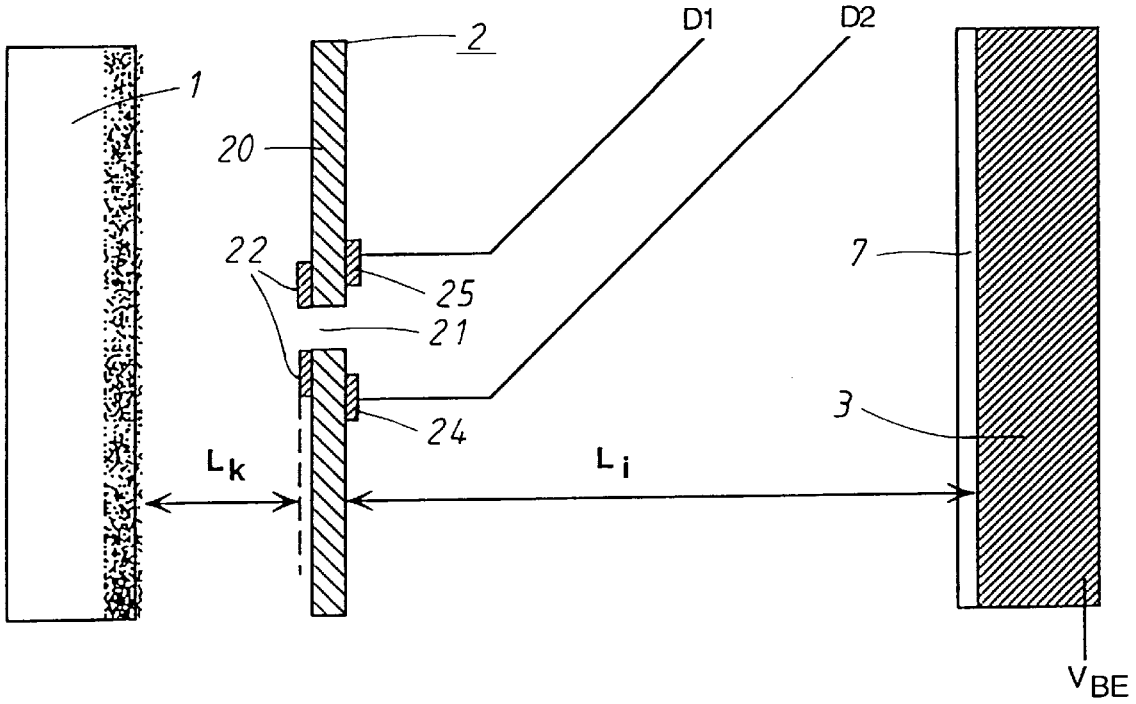
FIGS. 7 and 8 are schematic views of an aperture, its associated control electrode and deflection electrodes, and the voltages applied thereon.

According to a third embodiment of the present invention, shown in FIG. 7, the printhead structure 2 further includes an additional printed circuit, preferably arranged on the bottom surface of the substrate layer 20 and comprising at least two different sets of deflection electrodes 24, 25, each of which set is connected to a deflection voltage source (D1, D2). By producing an electric potential difference between both deflection voltage sources (D1, D2), the symmetry of the electrostatic fields produced by the control electrodes 22 is influenced in order to slightly deflect the transport trajectory of the toner particles.

Figure 8:
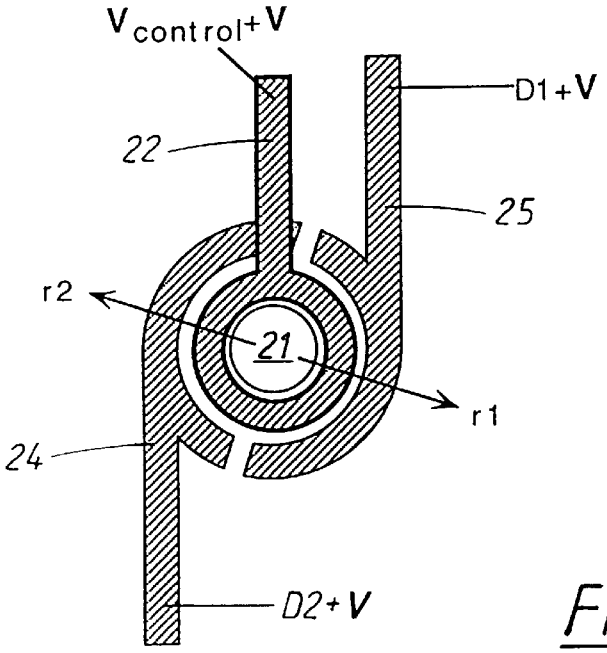

As is apparent from FIG. 8, the deflection electrodes 24, 25 are disposed in a predetermined configuration such that each aperture 21 is partly surrounded by a pair of deflection electrodes 24, 25 included in different sets. Each pair of deflection electrodes 24, 25 is so disposed around the apertures that the electrostatic field remains symmetrical about a central axis of the aperture as long as both deflection voltages D1, D2 have the same amplitude. As a first potential difference (D1<D2) is produced, the stream is deflected in a first direction r1. By reversing the potential difference (D1>D2), the deflection direction is reversed to an opposite direction r2. The deflection electrodes have a focusing effect on the toner particle stream passing through the aperture and a predetermined deflection direction is obtained by adjusting the amplitude difference between the deflection voltages.

In the above mentioned case, the method is performed in consecutive print cycles, each of which includes several, for instance two or three, development periods $t_b$, each development period corresponding to a predetermined deflection direction. As a result, several dots can be printed through each aperture during one and the same print cycle, each dot corresponding to a particular deflection level. This method allows higher print resolution without the need for a larger number of control voltage sources (IC-drivers). When performing dot deflection control, it is an essential requirement to achieve a high speed transition from one deflection direction to another.

Figure 9A:
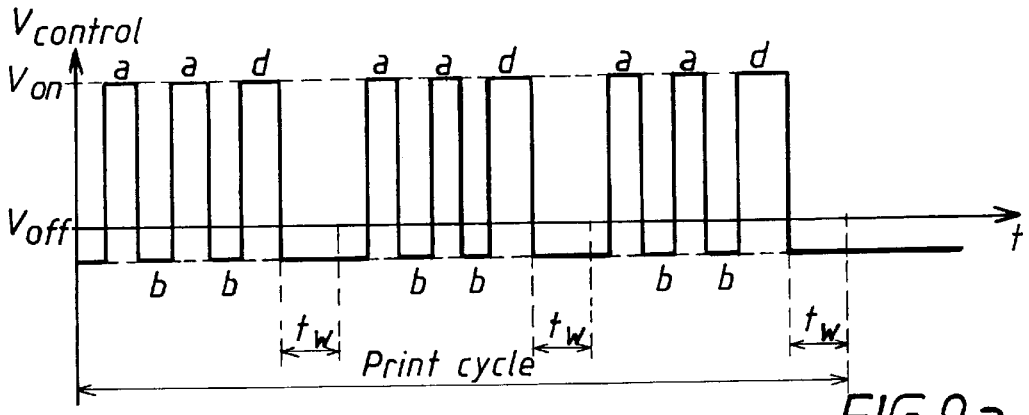
FIG. 9*a* is a diagram showing the control voltages applied to a selected control electrode during a print cycle including three development periods $t_b$ and three recovery periods $t_w$, utilizing dot deflection control.
Figure 9B:
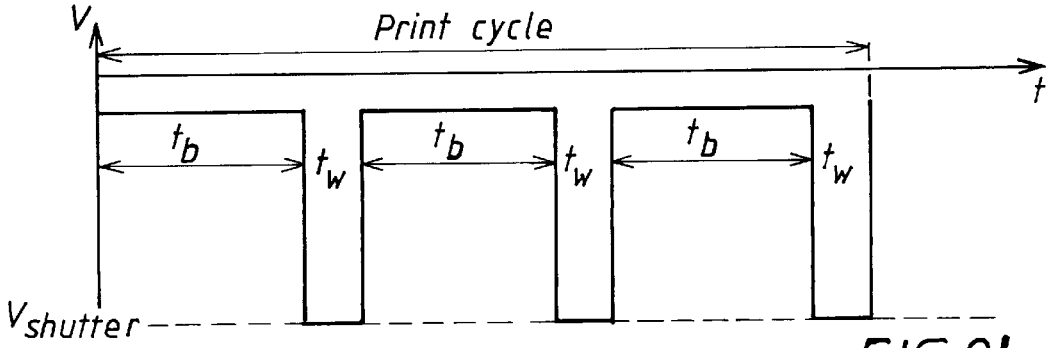
FIG. 9*b* is a diagram showing the periodic voltage pulse V applied to all control electrodes and deflection electrodes during a print cycle including three development periods $t_b$ and three recovery periods $t_w$, utilizing dot deflection control.
Figure 9C:
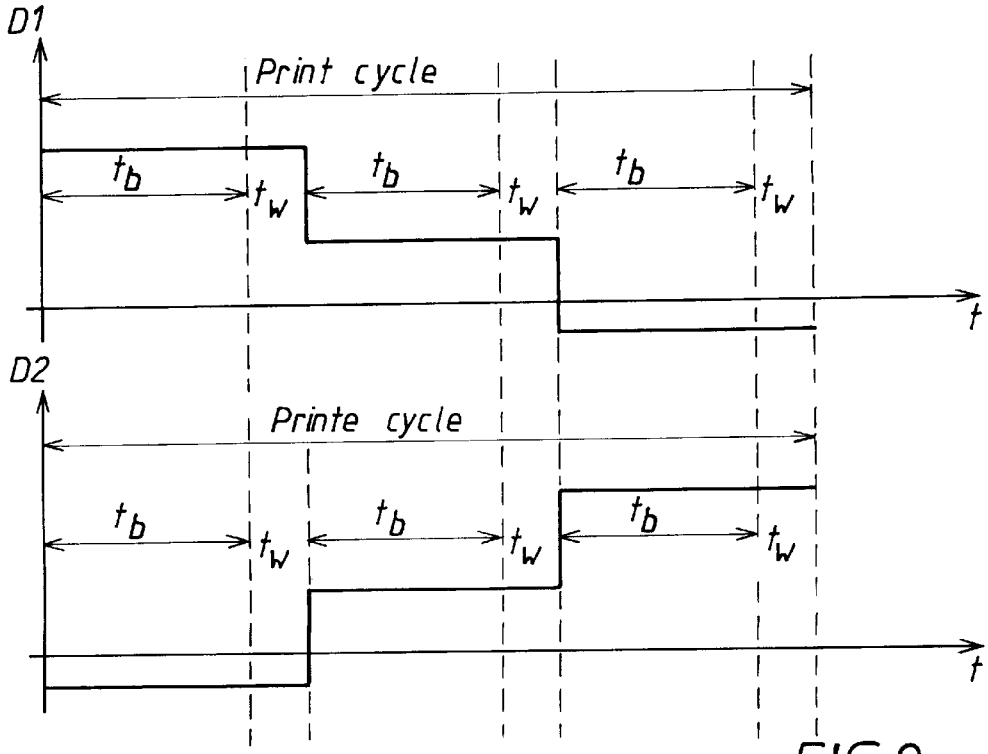
FIG. 9*c* is a diagram showing the deflection voltages D1 and D2 applied to a first and a second set of deflection electrodes, respectively, utilizing dot deflection control with three different deflection levels.

The present invention is advantageously carried out in connection with dot deflection control, as apparent from FIGS. 9*a*, 9*b* and 9*c*. FIG. 9*a* is a diagram showing the control voltages applied to a control electrode during a print cycle including three different development periods $t_b$, each of which is associated with a specific deflection level, in order to print three different, transversally aligned, adjacent dots through one and the same aperture. Each $t_b$+$t_w$ period substantially corresponds to that which is shown in FIG. 2, i.e. a plurality of control voltage pulses are used at the beginning of $t_b$. FIG. 9*b* shows the periodic voltage pulse. According to a preferred embodiment of the invention, the periodic voltage pulse is simultaneously applied to all control electrodes and to all deflection electrodes. In that case, each control electrode generates an electrostatic field produced by the superposition of the control voltage pulse and the periodic voltage pulse, while each deflection electrode generates a deflection field produced by the superposition of the deflection voltages and the periodic voltage pulse. FIG. 9*c* shows the deflection voltages applied to two different sets of deflection electrodes (D1, D2). During the first development period, a potential difference D1>D2 is created to deflect the particle stream in a first direction. During the second development period, the deflection potentials have the same amplitude, something which results in printing a central located dot. During the third development period, the potential difference is reversed (D1<D2) in order to obtain a second deflection direction opposed to the first. The superposition of the deflection voltages and the periodic pulse produce a focusing potential, while maintaining the deflection potential difference during each recovery period.

Although it is preferred to perform three different deflection steps (for instance left, center, right), the above concept is obviously not limited to three deflection levels. In certain applications, two deflection levels (for instance left, right) are advantageously performed in a similar way. The dot deflection control allows a print resolution of, for instance, 600 dpi utilizing a 200 dpi printhead structure and performing three deflection steps. A print resolution of 600 dpi is also obtained by utilizing a 300 dpi printhead structure performing two deflection steps. The number of deflection steps can be increased (for instance four or five) depending on different requirements, such as for instance print speed, manufacturing costs or print resolution.

Each pair of deflection electrodes is arranged symmetrically about a central axis of its corresponding aperture, whereby the symmetry of the electrostatic field remains unaltered as long as both deflection potentials D1 and D2 have the same amplitude.

All deflection electrodes are connected to at least one voltage source which supplies a periodic voltage pulse oscillating between a first voltage level, applied during each of said development periods $t_b$, and a second voltage level (e.g. $V_{off}$ or $V_{shutter}$), applied during each of said recovering periods $t_w$.

The deflection potential difference is preserved during at least a part of each recovery period $t_w$, until the toner deposition is achieved. After each development period, a first electric field is produced between a shutter potential on the deflection electrodes and the background potential on the back electrode. Simultaneously, a second electric field is produced between a shutter potential on the control electrodes and the potential of the particle source (preferably 0 V). The toner particles which, at the end of the development period $t_b$, are located between the printhead structure and the back electrode are accelerated toward the image receiving medium under influence of said first electric field. The toner particles which, at the end of the development period $t_b$, are located between the particle source and the printhead structure are repelled back onto the particle source under influence of said second electric field.

Figure 10A:
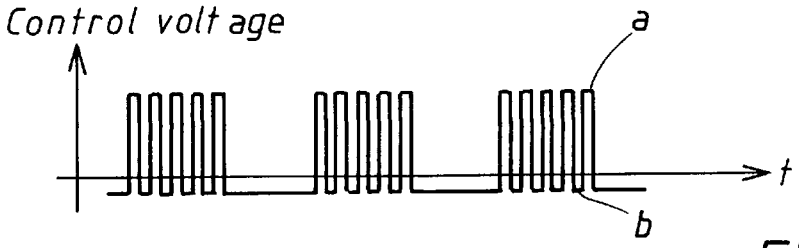
FIG. 10*a* is a diagram showing the total control voltage signal applied to a pair of selected deflection electrodes during a print cycle of a preferred embodiment of the invention.
Figure 10B:
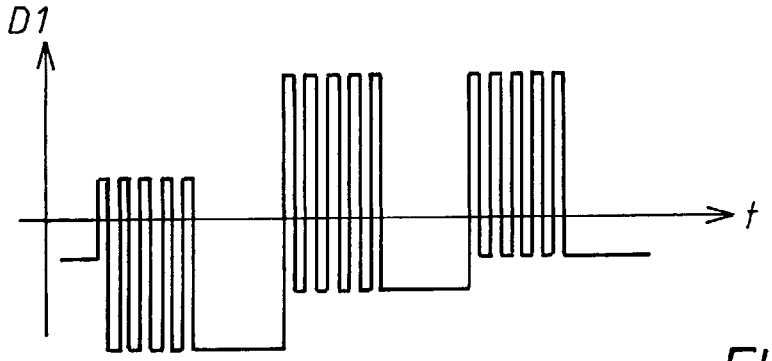
FIG. 10*b* is a diagram showing a deflection voltage Dl applied to a first deflection electrode of the pair as in FIG. 10*a;*
Figure 10C:
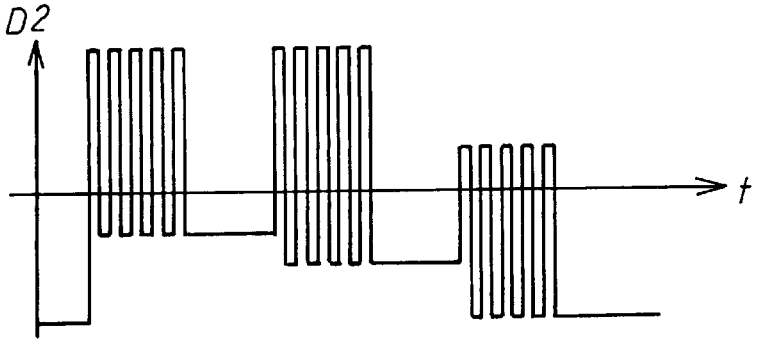
FIG. 10*c* is a diagram showing a deflection voltage D2 applied to a second deflection electrode of the pair as in FIG. 10*a*.
Figure 10D:
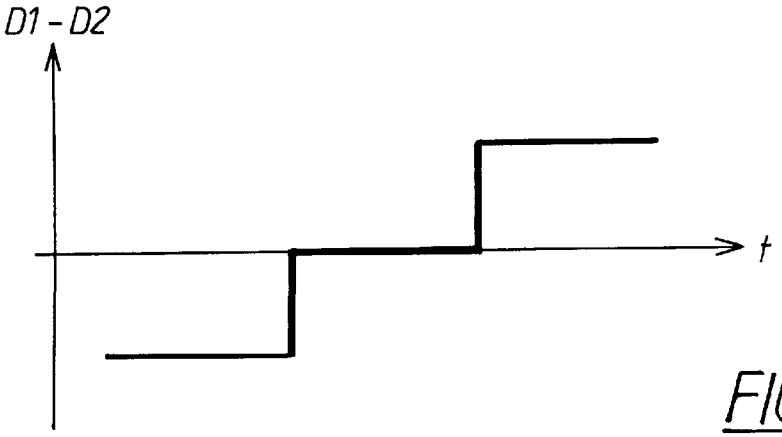
FIG. 10*d* is a diagram showing the difference signal between D1 and D2 as per FIGS. 10*b* and 10*c*.

Referring to FIGS. 10*a* to 10*d*, in this variation of the third embodiment of the invention the on-off signal is applied to the control electrodes 22 to open or close the aperture and the multiple pulse signal is applied to the deflection electrodes 24, 25 to form a control signal according to FIG. 10*a*. This control signal is similar in function and appearance to that of FIG. 2. The control signal is the sum of two different deflection signals D1 and D2, respectively, applied to the two deflection electrodes 24, 25. Deflection signal D1 is shown in FIG. 10*b* and deflection signal D2 is shown in FIG. 10*c*. The difference between the two deflection signals, D1−D2, regulates the relative symmetry of the electrical field generated by the voltage applied to the deflection electrodes and is shown in FIG. 10*d*. The symmetry is thus changed when the difference between the two deflection signals changes, in an analogous manner to FIG. 9*a* to 9*c*.

During an a-pulse, as shown in FIG. 10*a*, the deflection signals D1 and D2 attract the toner particles, thereby enhancing toner release from the toner particle source. This a-pulse has a voltage level referred to as the release level.

During a b-pulse, as shown in FIG. 10*a*, the deflection signals D1 and D2 repel the toner particles, causing the toner particles to flow towards the image receiving medium under the focusing influence of converging forces.

According to other embodiments of the invention, the periodic voltage pulse is applied only to all deflection electrodes or only to all control electrodes.

Another advantage with a multiple pulse printing method according to the invention is that a smaller quantity of toner particles is contained in each toner stream, which may lead to a softer impact on the image receiving medium, thus resulting in less scattering of toner particles on the medium.

An image receiving medium 7, such as a sheet of plain untreated paper or any other medium suitable for direct printing, is caused to move between the printhead structure 2 and the back electrode 3. The image receiving medium may also consist of an intermediate transfer belt onto which toner particles are deposited in image configuration before being applied to paper or another information carrier. Intermediate transfer belts may be advantageously utilized in order to ensure a constant distance $L_i$ and thereby a uniform deflection length.

In particular embodiments of the invention, the voltage signals are supplied to the electrodes using driving means, such as conventional IC-drivers (push-pull) having typical amplitude variations of about 400 V. Such an IC-driver is preferably used to supply a potential in the range of −50 V to +350 V for $V_{off}$ and $V_{on}$, respectively. The periodic voltage pulse preferably oscillates between a first level substantially equal to $V_{off}$ (i.e. about −50 V) to a shutter potential level in the order of $-V_{on}$ (i.e. about −350 V). The amplitude of each control potential determines the quantity of toner particles allowed to pass through the aperture. Each amplitude level comprised between $V_{off}$ and $V_{on}$ corresponds to a specific shade of grey. Shades of grey are obtained either by modulating the dot density while maintaining a constant dot size, or by modulating the dot size itself. Dot size modulation is obtained by adjusting the levels of both deflection potentials in order to produce variable converging forces on the toner particle stream. Accordingly, the deflection electrodes are utilized to produce repelling forces on toner particles passing through an aperture such that the transported particles are caused to converge toward each other, resulting in a focused stream and thereby a smaller dot. Grey scale capability is significantly enhanced by modulating those repelling forces in accordance with the desired dot size. Grey scale capabilities may even be enhanced by modulating the pulse width of the applied control potentials.

The printhead structure is preferably formed of a substrate layer of electrically insulating material, such as polyimid or the like, having a top surface facing the particle source, a bottom surface facing the image receiving medium and a plurality of apertures arranged through the substrate layer for enabling the passage of toner particles through the printhead structure. Said top surface of the substrate layer is overlaid with a printed circuit including the array of control electrodes and arranged such that each aperture is at least partially surrounded by a control electrode.

All control electrodes are connected to at least one voltage source which supplies a periodic voltage pulse oscillating between at least two voltage levels, such that a first voltage level is applied during each of said development periods $t_b$ and a second voltage level ($V_{shutter}$) is applied during each of said recovering periods $t_w$ to close the apertures and thus prevent toner particles from passing through the apertures.

b An appropriate quantity of toner particles is released from the particle source during a development period $t_b$. At the end of the development period $t_b$, only a part of the released toner particles have already reached the image receiving medium. Of the remaining released toner particles, those which have already passed through the apertures in the printhead structure are accelerated toward the image receiving medium under influence of the shutter potential. The part of the released toner particles which, at the end of the development period $t_b$, are still located between the particle source and the printhead structure, are repelled back to the particle source under influence of the shutter potential.

The invention is not limited to the descriptions above nor to the examples shown on the drawings, but may be varied within the scope of the appended claims.

What is claimed is:

1. A direct electrostatic printing method for drawing toner particles from a toner particle source, through a printhead structure, and toward a back electrode, said method comprising the steps of:

generating a first electric field to attract a first plurality of toner particles from said toner particle source toward said printhead structure;

generating a second electric field to repel said first plurality of toner particles from said printhead structure back to said toner particle source, said first plurality of toner particles contacting said toner particle source to liberate a second plurality of toner particles from said toner particle source; and generating a third electric field to converge and focus said first plurality of toner particles and said second plurality of toner particles from said printhead structure toward said back electrode.

2. A direct electrostatic printing method of claim 1, wherein each generating step comprises creating said first electric field, said second electric field, and said third electric field by a series of voltage pulses.

3. The direct electrostatic printing method of claim 2, wherein said step of generating said first electric field comprises generating a first of said series of voltage pulses having a first polarity and generating said second electric field by a second of said series of voltage pulses having a second polarity, said second polarity being opposite said first polarity.

4. The direct electrostatic printing method of claim 3, wherein said step of generating said third electric field comprises generating a third of said series of voltage pulses having said first polarity.

5. The direct electrostatic printing method of claim 4, further comprising applying a fourth of said series of voltage pulses between said second of said series of voltage pulses and said third of said series of voltage pulses, said fourth of said series of voltage pulses neither attracting nor repelling said toner particles.

6. The direct electrostatic printing method of claim 3, further comprising the step of alternating between said first electric field and said second electric field a plurality of times before generating said third electric field.

7. The direct electrostatic printing method of claim 6, further comprising the step of increasing the amplitude of said series of voltage pulses generating the first electric field and said second electric field each time the first electric field and the second electric field are alternated.

8. The direct electrostatic printing method of claim 1, further comprising the step of applying a series of voltage pulses to control electrodes on a surface of said printhead structure facing said toner particle source to generate said first electric field, said second electric field, and said third electric field.

9. The direct electrostatic printing method of claim 1, further comprising the step of applying a series of voltage pulses to guard electrodes on a surface of said printhead structure facing said back electrode to generate said first electric field, said second electric field, and said third electric field.

10. The direct electrostatic printing method of claim 1, further comprising the step of applying a first series of voltage pulses to control electrodes on a surface of said printhead structure facing said toner particle source to generate said first electric field, said second electric field, and said third electric field.

11. The direct electrostatic printing method of claim 1, further comprising the step of applying a second series of voltage pulses to said guard electrodes to supplement said first electric field, said second electric field, and said third electric field.

12. The direct electrostatic printing method of claim 1, further comprising the step of applying a first series of voltage pulses to pairs of deflection electrodes on a surface of said printhead structure facing said back electrode to generate said first electric field, said second electric field, and said third electric field, wherein each pair of deflection electrodes at least partially encompasses an aperture in said printhead structure.

13. The direct electrostatic printing method of claim 12, further comprising the step of modifying the symmetry of an electric field around said apertures by applying a first of said series of voltage pulses to a first of said pair of deflection electrodes and a second of said series of voltage pulses to a second of said pair of deflection electrodes.

* * * * *